US006386291B1

(12) United States Patent
Short et al.

(10) Patent No.: US 6,386,291 B1
(45) Date of Patent: May 14, 2002

(54) SUBSEA WELLHEAD SYSTEM AND METHOD FOR DRILLING SHALLOW WATER FLOW FORMATIONS

(76) Inventors: David E. Short, 642 Cherrybark La., Houston, TX (US) 77079; William A. Valka, 22802 Canyon Lake, Spring, TX (US) 77373

( * ) Notice: Subject to any disclaimer, the term of this patent is extended or adjusted under 35 U.S.C. 154(b) by 0 days.

(21) Appl. No.: 09/685,448

(22) Filed: Oct. 12, 2000

(51) Int. Cl.[7] ..... E21B 33/43
(52) U.S. Cl. ..... 166/368; 166/285; 166/88.1
(58) Field of Search ..... 166/368, 88.1, 166/89.1, 89.2, 88.4, 339, 285, 382

(56) References Cited

U.S. PATENT DOCUMENTS 4,712,621 A * 12/1987 Wightman et al. ..... 166/382
5,188,181 A * 2/1993 Brammer et al. ..... 166/344
5,226,478 A * 7/1993 Henderson, Jr. et al. .... 166/285
5,240,081 A * 8/1993 Milberger et al. ..... 175/8
6,244,359 B1 * 6/2001 Bridges et al. ..... 175/5

* cited by examiner

*Primary Examiner*—Frank Tsay

(57) ABSTRACT

A shallow water flow subsea drilling system is disclosed. A wellhead system is provided with a 36" conductor pipe in which a 26" casing and 26" wellhead housing are landed. The 26" casing extends to a depth above a shallow water flow zone. A borehole through the shallow water flow zone is sized to accept a 20" casing to the top of which is secured an 18¾" wellhead housing. An annulus between the 26" and 18¾" housings communicates with cement returns from the 20" casing. Flow-by holes in the 26" wellhead housing are sealed with a retrievable seal assembly and actuating mechanism run on the same running tool with the 20" casing and 18¾" wellhead housing. A hydraulic feedback mechanism is provided to sense at the service vessel whether or not the seal assembly has been correctly positioned in the annulus. The seal assembly is pressure tested in the same trip while in its pack-off condition and can be retrieved with a second running tool trip.

9 Claims, 15 Drawing Sheets

SUBSEA WELLHEAD SYSTEM AND METHOD FOR DRILLING SHALLOW WATER FLOW FORMATIONS

BACKGROUND OF THE INVENTION

1. Field of the Invention

This invention relates generally to the field of subsea drilling and in particular to a wellhead arrangement for use in drilling through shallow formations beneath the sea bed which are water bearing and under pressure.

2. Description of the Prior Art

A common subsea drilling technique involves first providing a large diameter hole and installing a conductor casing typically 36" in diameter through the mud base of the seabed. Typically a low pressure or external wellhead housing is secured to the top of the conductor casing. Next, the well is bored through shallow earth formations to accept 26" casing. The 26" casing is installed in the hole with an internal or high pressure wellhead housing connected at its top and extends upwardly from the 26" casing. The 26" casing is cemented into the borehole through the use of a drill pipe conveyed cementing tool to the bottom of the hole. Cement is applied in the annulus between the 26" casing and the borehole and up through the annulus between the 26" casing and the 36" conductor pipe. The cement returns are through flow ports in the external wellhead. The flow ports remain open after the 26" casing is installed. Typically the 26" hole extends down to about 1,500 or 2,000 feet.

The drilling then proceeds through the 26" casing. A high pressure internal wellhead housing, a blowout preventer and a drilling riser are then installed. Two or more strings of casings are usually installed to line the borehole as it is drilled deeper through earth formations. Such strings of casings are landed and sealed in the internal wellhead housing. Such stings are cemented in place as described above with cementing tools landed in the wellhead housing and extending to the bottom of the casing.

The drilling procedure described above encounters problems where subsea formations include a shallow water flow zone, typically between 500 and 2,000 feet below sea bed. Such formations are water bearing and under pressure which exceeds sea floor water pressure by about 50 to 300 psi. When a 26" borehole is drilled through such shallow water flow zone, the pressurized formation water will find any upward path through the cement of the annulus, about the 26" casing and flow out the cement flow path of the external wellhead. Dangerous conditions may result from such flow at the sea bed. The well could become washed out.

Various solutions have been proposed to solve the problem of drilling through shallow water flow zones, typically found in the Gulf of Mexico. One solution is to use a foaming cement which retards washout.

U.S. Pat. No. 5,184,686 describes a system for avoiding washout, but it uses risers of two different diameters at various stages of drilling. The procedure is time consuming and expensive.

One prior system provides a ball valve in the flow ports of the external wellhead housing which may be closed by a Remotely Operated Vehicle (ROV) after the internal wellhead housing is provided. Closing the ball valves prevents shallow water flow zone water from leaking past the cemented annulus between the 26" casing and the external wellhead housing secured to the top of the 36" conductor pipe. Ball valves are expensive, add to operating difficulties and must be operated by means of an ROV.

U.S. Pat. No. 5,660,234 describes another prior system for solving problems associated with drilling through shallow water flow zones. The well is formed to a first depth, and 36" conductor pipe is installed with an external wellhead housing located at its upper end and extending above the sea bed. A reciprocating valve sleeve is mounted above the flow ports on the external casing. The well is drilled to a second depth at a level which is above the water flow zone. A string of casing is installed in the base, supported by a scab hanger and cemented into this section of the well. Typically such casing is 26" in diameter. This section of the well extends to a distance of about 300 feet about the water flow sand zone. The well is next drilled with a small diameter through the water flow sand. After drilling, the hole is swabbed with a foaming type cement to build up mudcake and retard washout. The well is then reamed to accept a smaller diameter casing, typically 20" in diameter. The 20" diameter casing is then run with a high pressure or internal wellhead housing located at its upper end. A running tool is used which latches to the external casing. The 20" casing is cemented into the hole with cement returns flowing out the open flow ports of the external wellhead housing. Once cementing is completed, the running tool is used to move the valve sleeve to the closed position, thereby closing the flow ports. The operator retrieves the running tool and installs a blowout preventer and drilling riser to the internal wellhead housing The well is then bored to greater depths with at least two casing strings installed. A monitoring valve is mounted in a monitoring port in a section of the conductor pipe between the landing sub and the external wellhead casing. A remote operated vehicle must be used to monitor the valve to determine whether or not pressure has built up in the annulus about the 26" casing.

A major disadvantage of the system described above is that it does not provide an indication, at the time of closing the valve sleeve, as to whether or not the shallow water flow ports are closed.

Another disadvantage of such system is that if the valve sleeves are faulty, they are not retrievable and replaceable, because they are part of the external wellhead housing Another disadvantage of such system is that the valve sleeve is not run independently of the external wellhead housing.

Still another disadvantage of the above system is that the efficacy of the closing of the flow ports must be sensed by a ROV, rather than remotely from a service work vessel.

Identification Of Objects Of The Invention

A primary object of this invention is to provide a wellhead system for shallow water flow zone drilling in which a replaceable pack-off device is used to seal off ports for shallow water zone return flows.

Another primary object of this invention is to provide a wellhead arrangement by which a feedback signal is produced at a surface vessel via a hydraulic flow path from the wellhead to indicate whether or not the pack-off device is properly set.

Another important object of the invention is to provide a wellhead arrangement for shallow water flow zone drilling in which a pack-off device is run at the same time as is an internal high-pressure wellhead housing with the 20" casing extending through the shallow water flow zone.

Another important object of the invention is to provide a running tool and method by which (1) a pack-off is set to close shallow water return flow ports from an annulus between external and internal wellhead housings, (2) the position of such pack-off is sensed remotely at the drilling vessel, (3) the pack-off is energized hydraulically from the drilling vessel, and (4) the pack-off can be replaced if a problem develops with the operation of the pack-off.

SUMMARY OF THE INVENTION

The objects identified above, as well as other advantages and features of the invention are embodied in a system which provides a cement return path in an annulus formed between the external housing (called the 26" housing because it is secured to the 26" casing) and an internal housing of 18¾" internal diameter (secured to 20" casing, but called herein as the 18¾" housing). The 26" housing connects to 26" pipe cemented in a borehole above a shallow water flow zone. The 18¾" housing is run, simultaneously by means of a running tool, with 20" casing, a seal assembly, and cementing equipment through a bore drilled through the zone of shallow water pressurized flow. The retrievable seal assembly is placed in the annulus between the 26" and 18¾" housings initially above the cement return flow ports. The running tool and subsea wellhead assembly includes devices for selectively forcing, via a hydraulic path from a service vessel a seal or pack-off of the seal assembly below the cement return flow ports, thereby sealing the annular space from formation water flow between the 26" and 20" casings. After the pack-off is set, the running tool is returned to the surface, and drilling and casing operations of the well continues through the wellhead system. If a problem were to develop with the seal, a running tool is provided for retrieving and replacing the pack-off The running tool and seal assembly are designed in order to force the pack-off of the seal assembly downward into the annulus below the flow ports with hydraulic pressure from the drill string forcing a piston downward against the seal assembly. A feedback mechanism is provided which generates a pressure signal at the surface vessel, via the hydraulic path, which is representative of the position of the pack-off in the annulus.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which:

FIGS. 2A-l (top) and 2A-2 (bottom) illustrate, in a diagrammatic sectional view, the subsea well of FIG. 1 after a borehole has been drilled through the shallow water flow zone and a running tool has been lowered to the well, where the running tool is secured to an 18¾" wellhead with 20" casing carried thereby, and where a cementing tool carried by the running tool has cemented the 20" casing to the formations of the borehole with returns through flow-by holes of the 26" wellhead housing, via an annulus between the 26" and 20" casings and a channel between the 26" and 18¾" wellhead housings and where an actuating mechanism and a seal assembly carried by the running tool are positioned such that the seal assembly extends into an annulus between the 26" and 18¾" housing with a seal above the flow-by holes;

FIG. 2B shows a hydraulic sub device secured in series with a drill string above the running tool of FIG. 2A, the hydraulic sub shown with hydraulic lines to the actuating mechanism of FIG. 2A and in an open position for cementing operations from a service vessel via the drill string;

FIG. 2C is an enlarged portion of FIG. 2A showing details of the actuating mechanism and its releasable securement to the seal assembly and showing a feedback mechanism to provide a hydraulic feedback signal to the surface vessel and further showing one portion of the seal assembly and a latching arrangement between the seal assembly and the actuating mechanism;

FIG. 2D is an enlarged portion of FIG. 2A showing details of the seal assembly with a hydraulic line for testing the seal assembly;

FIG. 6B-1 (top) and 6B-2 (bottom) illustrate a retrieving running tool reentering the 18¾" wellhead housing and with the hydraulic actuating mechanism secured to a latching mechanism;

FIGS. 6D-1 (top) and 6D-2 (bottom) illustrate the running tool being raised to the service vessel with the pack-off assembly removed from the wellhead assembly.

DESCRIPTION OF THE PREFERRED EMBODIMENTS OF THE INVENTION

Figure 1:
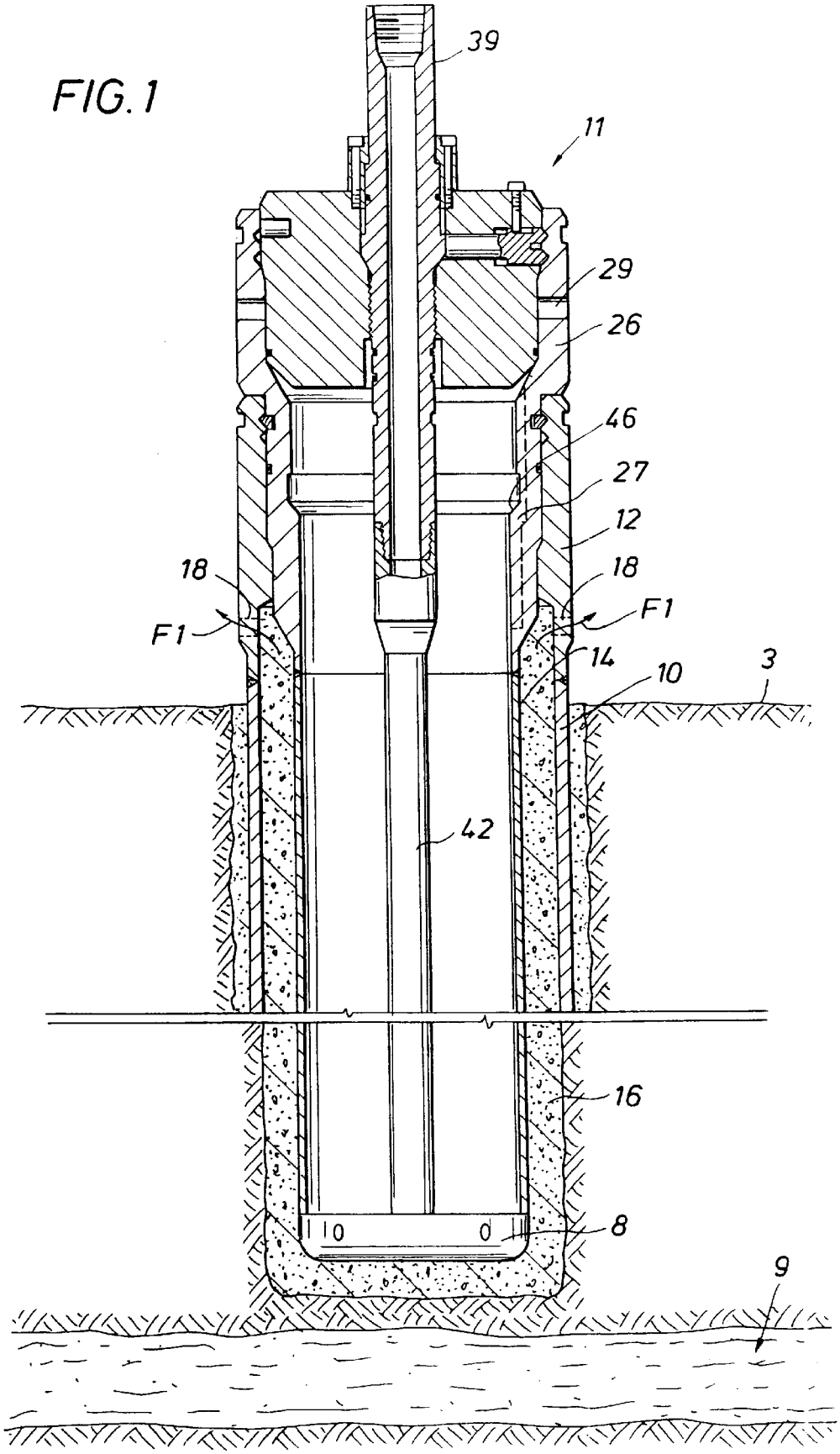
FIG. 1 is a diagrammatic sectional view of a partial subsea wellhead installation in which a 36" wellhead housing with a 36" conductor pipe are installed in the sea floor and showing a running tool installing a 26" wellhead housing and a 26" pipe in a borehole running to a depth above a shallow water flow zone.

FIG. 1 illustrates a subsea wellhead assembly with a 36" wellhead assembly 12 secured to the top of a 36" conductor pipe 10 which is positioned within a hole in the seal floor 3 and formed and secured in the hole in a conventional manner. A borehole has been reamed through the 36" conductor pipe 10 large enough to accept a 26" pipe 14. Such borehole terminates (as shown diagrammatically) above the known depth of shallow water flow zone 9.

A running and cementing tool 11 conveyed by a drill pipe string from a service vessel (not shown) is releasably secured to the 26" wellhead housing 26 which carries the 26" pipe 14 into the borehole. The drill pipe suing is connected to tool 11 at threaded coupling 39 (not shown). A cementing shoe 8 communicates with cementing apparatus at the surface vessel via the drill pipe string. A lower portion 42 of a conduit which connects from the drill sting is carried by running and cementing tool 11. Cement 16 is forced to flow at the bottom of the hole and upwardly via the annulus between the outer diameter of 26" casing 14 and the borehole and the inner diameter of 36" conductor pipe 10 and out flow-by holes 18 as indicated by flow direction arrows F1. Flow-by holes 29 are provided in 26" wellhead housing 26, and an internal landing profile 46 is provided in housing 26 for supporting the high pressure internal wellhead housing to be run next. A cement return channel 27 is provided in the 26" wellhead housing 26.

Figures 1, 2A:
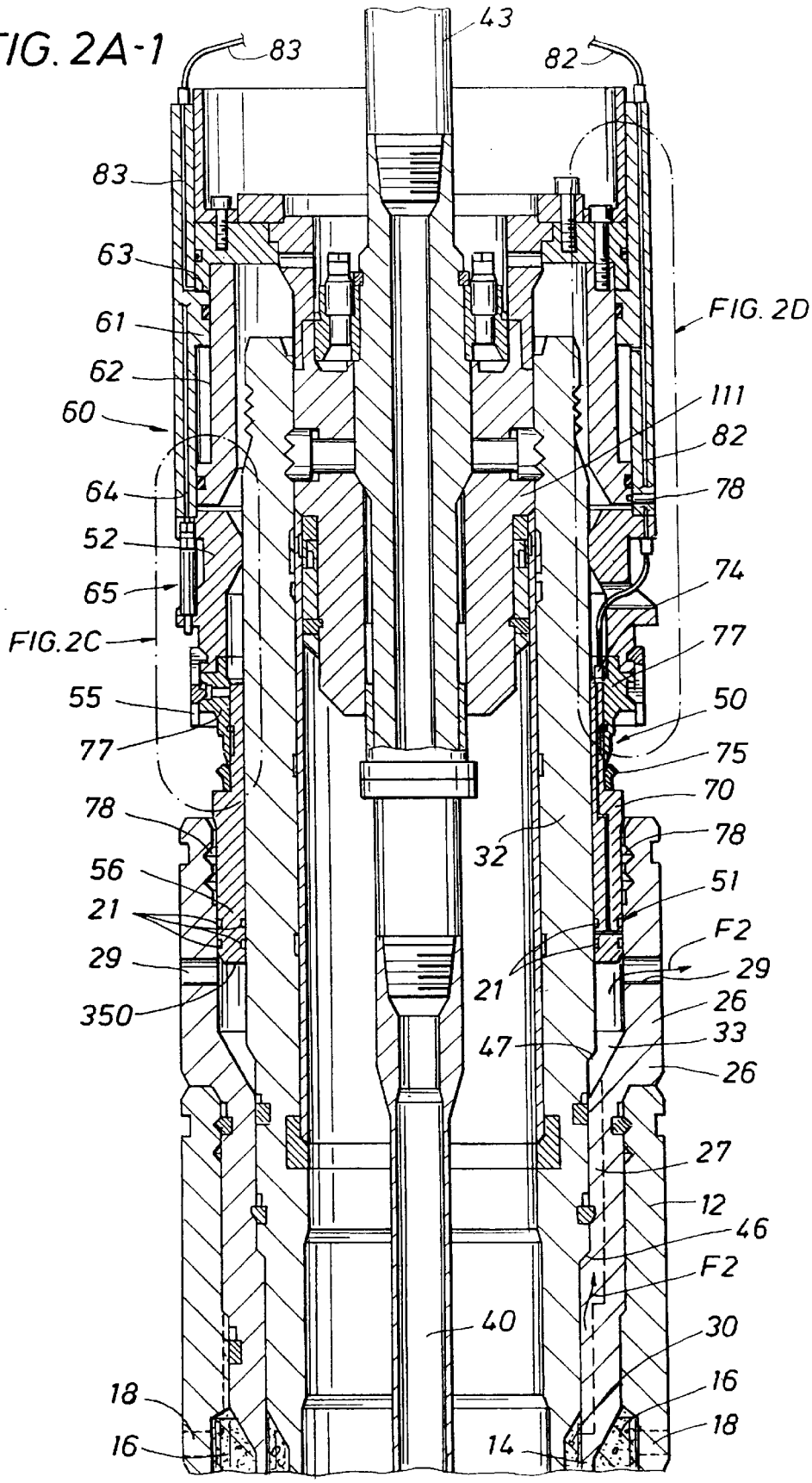

FIGS. 2A-1 (top) with 2A-2 (bottom) illustrate the configuration of the well after a borehole has been drilled through the 26" casing 14 and a running tool 111 (FIG. 2A-1) has been run into the well via drill pipe 43, from a service vessel with hydraulic sub (FIG. 2B) secured to the top of running tool 111 and to a drill string 95. The running tool 111 carries an 18¾" high-pressure wellhead housing 32 and a string of 20" casing 30 into the borehole 19 through shallow water flow zone 9. The running tool 111 is also coupled to and carries cementing pipe string 40 which has a cementing shoe 21 provided at its bottom end.

The 18¾' internal wellhead housing 32 has an external landing profile 47 which lands on and is supported by the internal landing profile 46 of the 26" external wellhead housing 26. The exterior of 18¾" wellhead housing 32 and the interior of housing 26 define an annulus 33. Flow-by holes 29 and channel 27 in the 26" wellhead housing provide a cement return path during cementing operations for securing 20" casing 30 to borehole 19 and the interior of 26" casing 14.

The wellhead running tool 111 carries a hydraulic actuator 60 which is coupled to a seal assembly 50. Such seal assembly 50 includes a seal or pack-off 51. When the 18¾" wellhead housing 32 is landed in the 26" wellhead housing 26, the 26"×20" seal assembly 50 is positioned in annulus 33 as illustrated in FIG. 2A-1 with the pack-off 51 located above the cement flow-by holes 29.

In the configuration state of FIG. 2A-1, the cementing shoe 21 (FIG. 2A-2) provides cement via cementing tubular 40 from a service vessel via drill pipe 43, hydraulic sub 80 and drill string 95. Cement 41 is forced out the bottom of the bore hole 19 and up the annulus between the outer diameter of 20" casing 30 and the bore hole 19, through the annulus of the shallow water flow zone 9 and the annulus between the outer diameter of 20" casing 30 and inner diameter of 26" pipe 14. The cement is forced upward via channel 27, to annulus 33, and out the cement flow-by holes 29, while seal assembly 50 is in its upward position of FIG. 2A-1. While the seal assembly 50 is in its upward position, formation pressurized water may find a path via the cement return path and out the flow-by holes 29 as indicated by flow arrows F2.

As will be explained below, the arrangement of FIGS. 2A-1, 2A-2 and 2B provide a well tool running tool 111 and method by which, with one trip of drill string to the well the 20" casing 30 is run with 18¾" wellhead housing 32, with the cementing apparatus 40, 21, and with a replaceable seal assembly 50 and actuator 60.

The hydraulic actuator 60 has connected to it a first hydraulic line 83 and a second hydraulic line 82 from hydraulic sub 80 (FIG. 2B) which is secured by threaded connection 81 to the wellhead running tool 111 (FIG. 2A-1) via drill pipe 43. Hydraulic sub 80 is run on drill pipe string 95 and includes a hydraulic actuating or "set" line 83 and port 85 and a hydraulic seal test line 82 and port 87. In the initial configuration with the running of hydraulic sub 80 with 18¾" wellhead running tool 111, a sealing sleeve 87 is provided which blocks pressurized drilling fluid to port 85 and hydraulic set line 83, and a sealing sleeve 89 is provided which blocks pressurized drilling fluid to port 87 and to hydraulic test line 82. In the configuration of FIGS. 2A-1, 2A-2 and 2B, cement may be pumped through the interior spaces 89', 87' of sleeves 89, 87 and through running tool 111 (FIG. 2A) and cementing tubular string 40 for cementing operations.

As explained below by reference to FIGS. 3A, 3B, and 3C, darts are dropped through the interior of the drill string from the drilling vessel after cementing operations have ceased, to first land within sealing sleeve 87 and to enable pressure from the drill string to force it downward, while blocking the interior of the drill string below the hydraulic sub 80. In this condition hydraulic pressure is first applied to hydraulic line 83 for positioning seal assembly 50 downward into annulus 33. Later, a second dart is dropped in the interior of the drill string to land within sealing sleeve 89. Hydraulic pressure is applied to force the second dart downward while sealing the interior of the sub below such second dart, so that hydraulic pressure from the interior of the drill string may be directed to the test hydraulic line 82.

FIGS. 2A-1, 2C and 2D illustrate the initial running arrangement of hydraulic actuator 60 and seal assembly 50 which is releasably coupled thereto.

Description of Hydraulic Actuator 60

Hydraulic actuator 60 includes an annular piston 61 (see FIGS. 2A-1 and 2C) which is free to move downwardly around cylinder 62 when pressurized fluid is applied via line 83 to piston head 63 (see FIG. 2A-1). A passage 64 (see FIG. 2C) for hydraulic pressurized fluid communicates with line 83 and extends downwardly to a feedback circuit mechanism 65. The lower end of piston 61 is fastened to connection member 52 which is free to slide about the outer cylindrical profile of the 18¾" wellhead housing 32. Connector member 52 includes an anti-rotation key 53 secured at its bottom end which has an inclined surface 54 which contacts with a cooperating surface 56 of running and retrieval ring 55 which releasably secures actuator 60 to seal assembly 50.

Description of Seal Assembly 50

As illustrated in FIGS. 2A-1, 2C and 3A, seal assembly 50 includes a pack-off body 70 having at its lower end a seal or pack-off member 51 which includes pack-off glands 21, such as O rings, which seal the annulus 33 inwardly and outwardly. A hydraulic line 73 in body 70 communicates to pressurize seal 51 and runs to a quick disconnect fitting 74 for connection to hydraulic line 82 (see FIG. 2A-1). A lock ring 75 (See FIGS. 2A-1, 2C) is engaged by a retainer strip and wedge number 76 and lock ring energizer 77. A shear pin 108 prevents lock ring energizer 77 from moving downwardly until sufficient actuating force is applied by actuator 60 (see FIGS. 2A and 2C). When actuator 60 is energized by hydraulic pressure to hydraulic line 83, downward force is applied by piston 61 which severs shear pin 108 and forces lock ring energizer 77 downward thereby forcing seal assembly 50 further downward into the annulus 33 until the lower end of the seal assembly 50 engages the bottom end of the annulus. With continued downward force on lock ring energizer 77 the wedge member 76 is forced downward and engages lock ring 75 and with caming action of surface 110 forcing it radially outward into groove 78.

Description of Feedback Circuit 65

Figures 2, 2A:
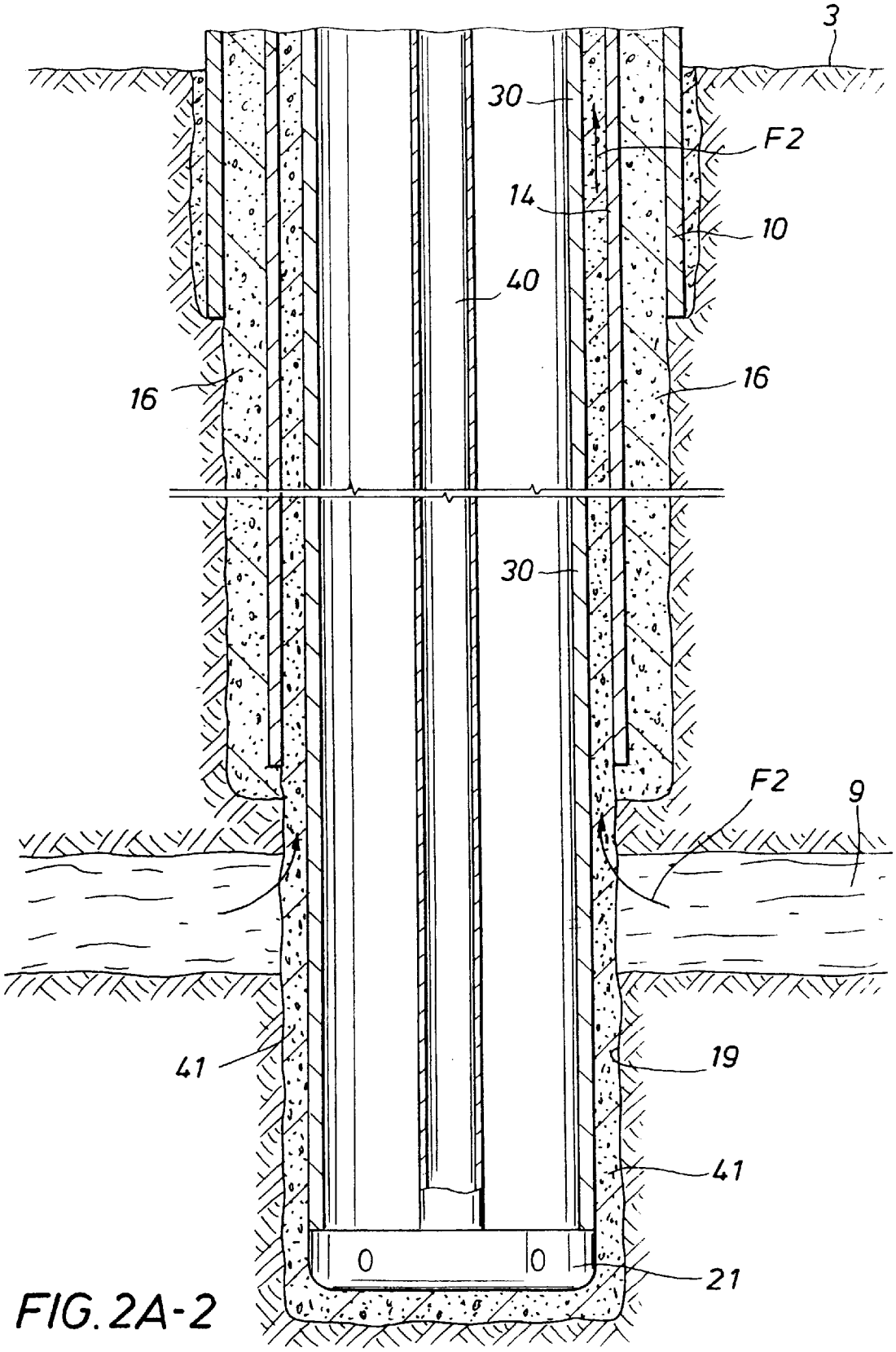
Figure 2B:
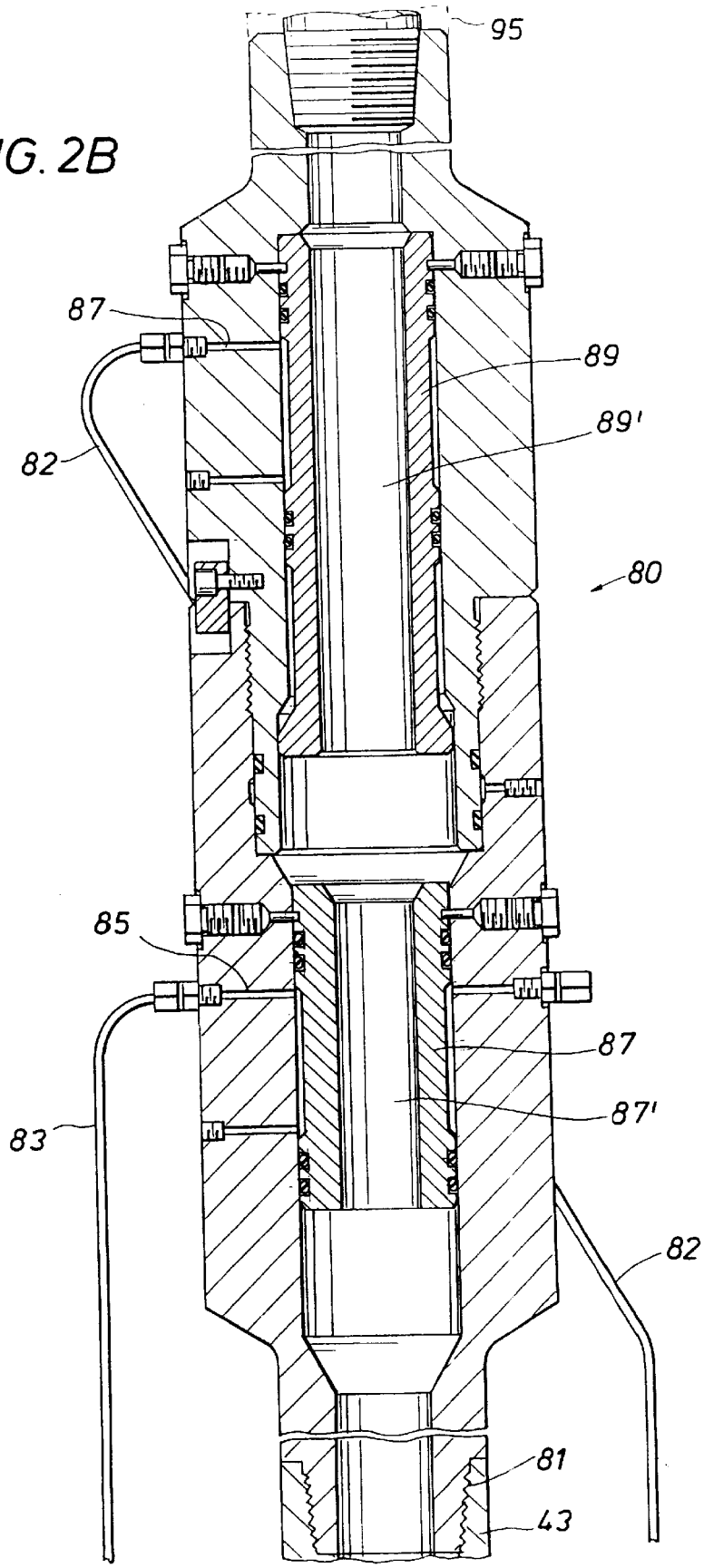
Figure 2D:
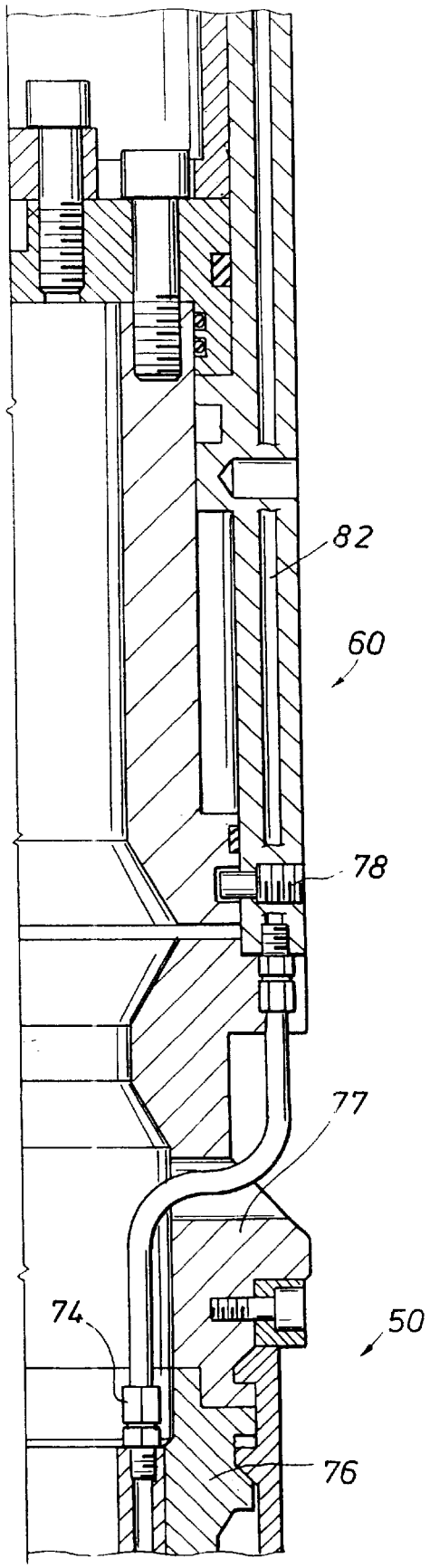
Figure 2C:
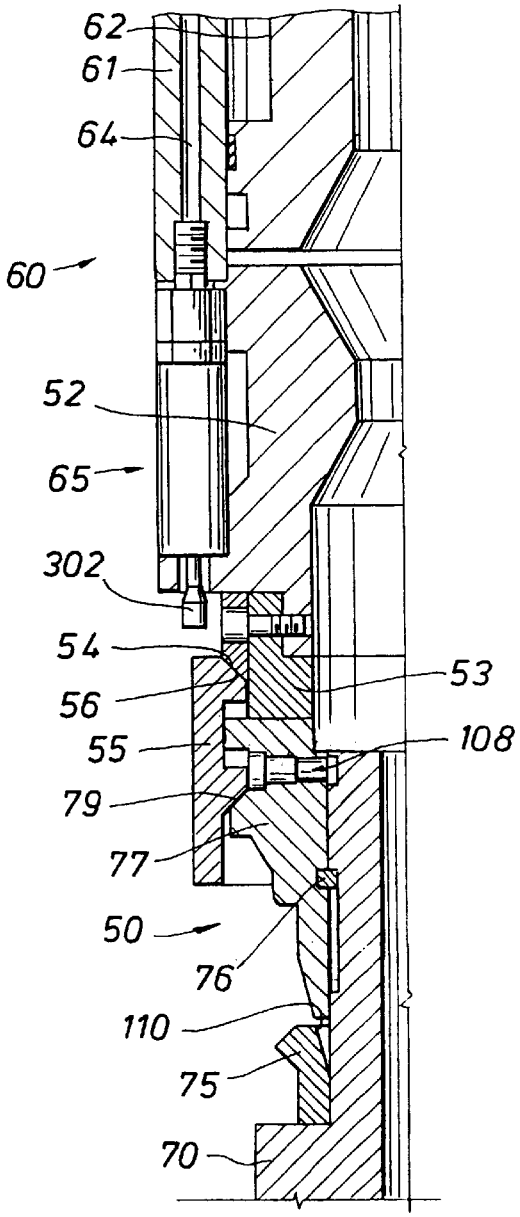
Figure 3A:
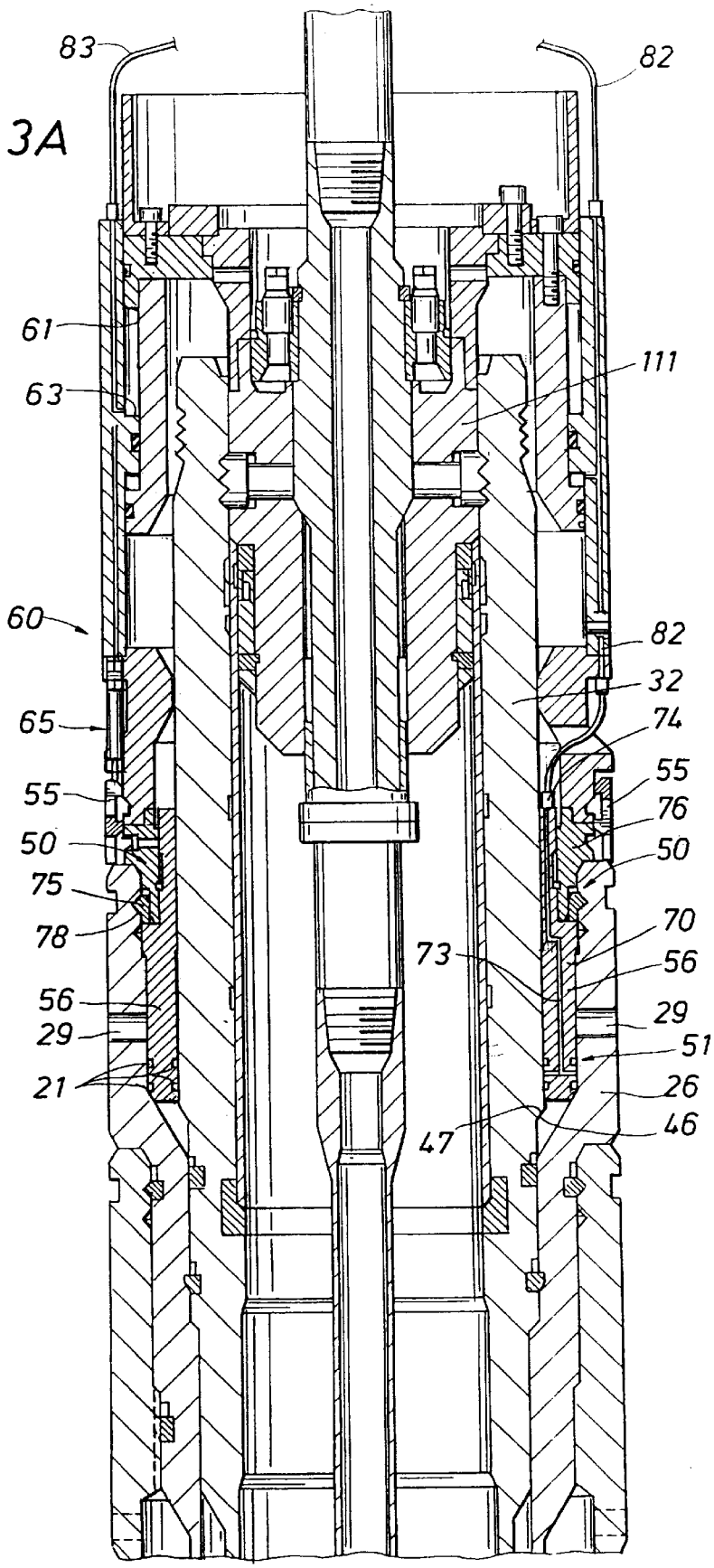
FIG. 3A is a sectional diagram which illustrates the subsea well of FIG. 2A after hydraulic pressure is applied to the actuating mechanism and the seal assembly has been forced downwardly into the annulus between the 26" and 18¾" housings with its pack-off below the flow-by holes of the 26" wellhead housing, thereby sealing the path between the 26" casing and the 20" casing.
Figure 4:
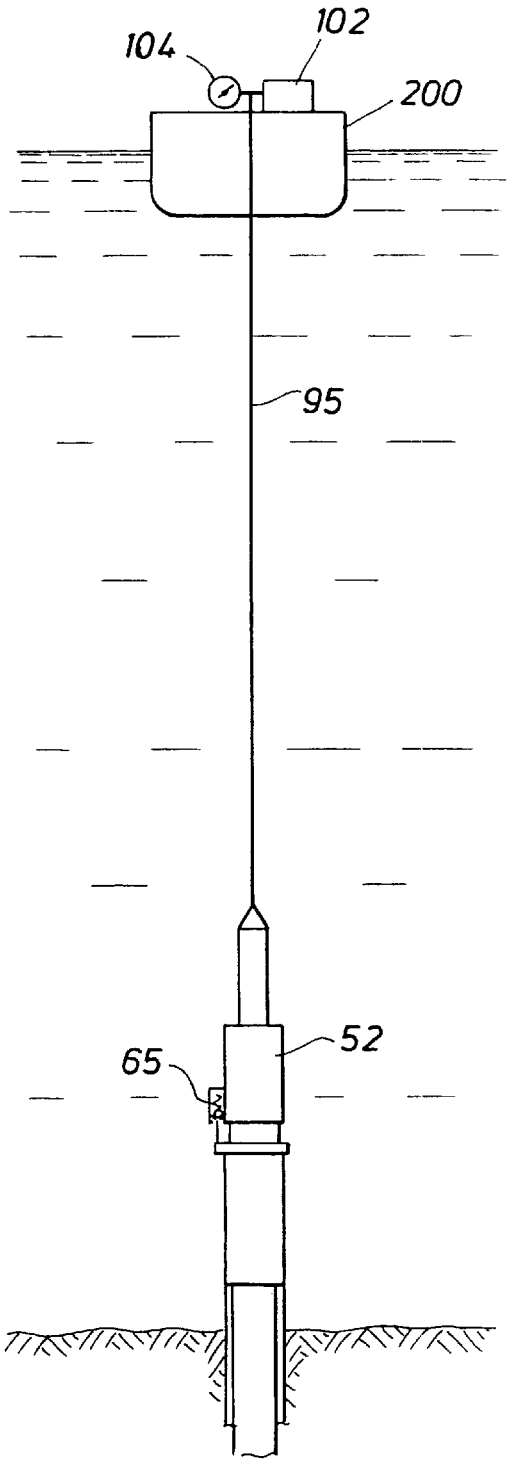
FIG. 4 is a diagrammatc view illustrating the feedback mechanis of FIG. 2A-5 1 via a hydraulic path to a pressure gage on the service vessel.
Figure 5:
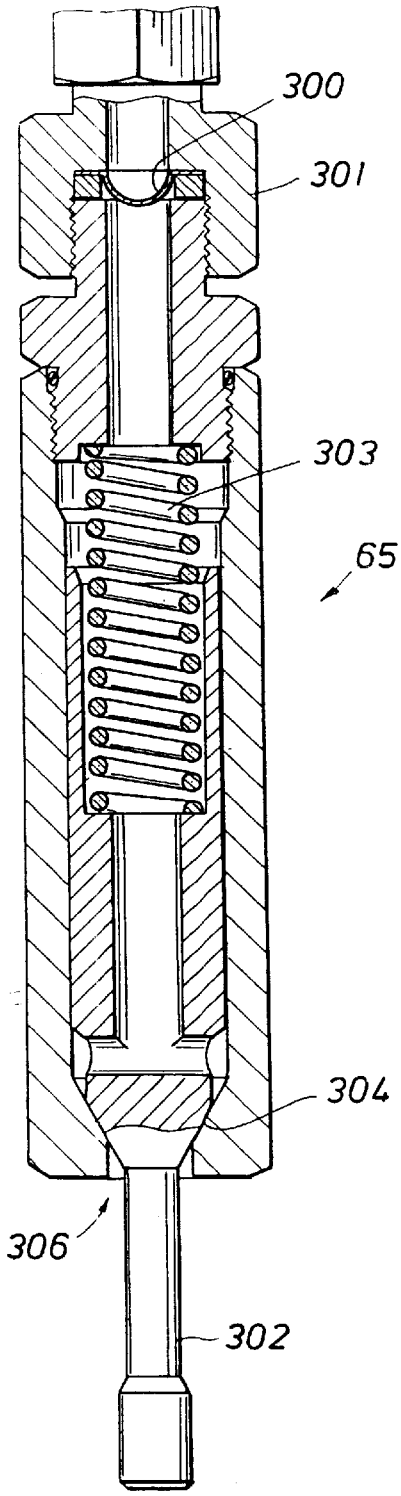
FIG. 5 is an illustration of the poppet valve and rupture disk of the feedback mechanism of FIGS. 2C, 2A-1, and 4.

As shown diagrammatically in FIG. 4, a feedback circuit device 65 is secured to a top connection member 52. A detailed drawing of device 65 of FIG. 5 shows that device 65 includes a rupture disc 300 in series with a spring loaded position sensitive poppet valve 306. FIGS. 2C, 3A, and 5 illustrate the operation of the feedback circuit mechanism. FIG. 3A indicates that position feedback sensor 65 is placed at the wellhead 32 between the seal assembly 50 and an actuator 60. A hydraulic path extends via drill string 95 to a service vessel 200 and mud pumps 102. A pressure gage 104 in the hydraulic path at the service vessel 200 enables an operator to determine the level of pressure in the hydraulic path as governed by the feedback mechanism 65.

FIG. 5 illustrates the components of the feedback mechanism 65. A 3,000 psi rupture disk 300 is provided in a rupture disk holder assembly 301. A spring loaded plunger 302 is mounted in series with rupture disk 300 such that when moved toward rupture disk 300 against a predetermined downward force of spring 303, a passage about surface 304 is opened. As illustrated in FIGS. 2C and 3A when the actuator 60 moves seal assembly 50 down to its terminal position in annulus 33, and if it is in the locked position, continued downward movement of connection member 52 against seal assembly 50 causes latch ring 55 to pivot about surface 79 (see FIG. 2C) of lock ring energizer 77 and have its top portion surface 56 cammed radially outwardly about surface 54, thereby forcing it outwardly in-line with the end of plunger 302.

Description of Setting Seal Assembly 50

After cementing operations are complete, as described above by reference to FIGS. 3A and 3B, a first or "lower" dart 106 (see FIG. 3B) is launched through the interior of the drill string 95. The lower dart 106 passes through the interior passage of the upper sealing sleeve 89 and lands within lower sealing sleeve 87. Next, the hydraulic path, via drill string 95 to mud pumps 102 and gage 104 (see FIG. 4), is pressured up to 1,000 psi causing lower sealing sleeve 87 to shift downward until lower sealing sleeve 87 is landed in a downward position. Port 85 is now open to the hydraulic path through the interior passage of hydraulic sub 80 to the drill string 95 to mud pumps 102. As a result, port 85 and hydraulic line 83 have pressurized well fluid applied to them which is applied to piston 61 of actuator 60, thereby driving seal assembly 50 downward. With increased pressure of 2,000 psi the shear pins 108 are sheared in the seal or pack-off assembly 50, thereby causing locking ring 75 to move radially outwardly into latching groove 78 (see FIG. 3A) thereby latching the pack-off assembly 50 to the 26" wellhead housing 26.

Figure 3B:
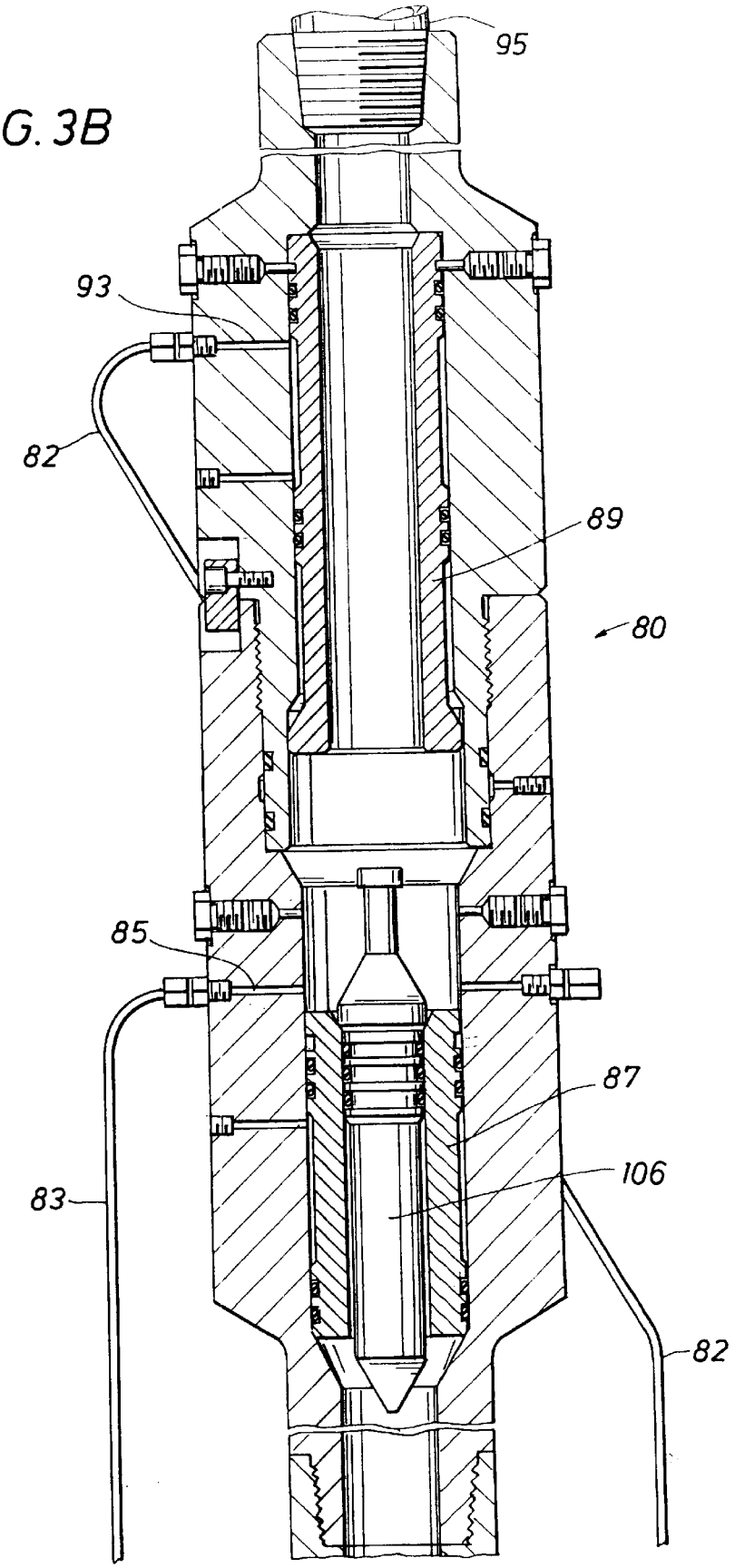
FIG. 3B shows the condition of the hydraulic sub of FIG. 2B after a first dart has been installed for enabling actuating pressure to the actuating mechanism of FIG. 2B.

Next the hydraulic pressure in the drill pipe is increased to 3,000 psi thereby rupturing rupture disk 300 of sensing device 65 (see FIGS. 2C, 3A, and 5). If the pack-off assembly 50 is properly set, latch ring 55 has moved radially outward to engage plunger 302 of poppet valve 65. In this condition the pressure will bleed off through the ruptured rupture disk 300 and valve opening 306 (FIG. 5), and an indication of same is observable at gage 104 at the surface vessel 200 of FIG. 4.

If the pressure does not bleed off at over 3,500 psi, that fact is an indication that poppet valve 306 has not opened and that the pack-off assembly 50 is not filly down and properly set. Next the operator pressures the hydraulic path up to 4,500 psi to set the pack-off assembly 50. If the pack-off assembly 50 sets, the poppet valve 306 opens as described above, thereby venting the pressure and providing a surface indication at gage 104 that the pack-off assembly is properly set If the pack-off assembly 50 does not set, the pack-off assembly is retrieved with the running tool 111 by rotating it from engagement with the 18¾" wellhead assembly 32 and pulling it out of the borehole.

Description of Pressure Testing of Pack-off Assembly 80

Figure 3C:
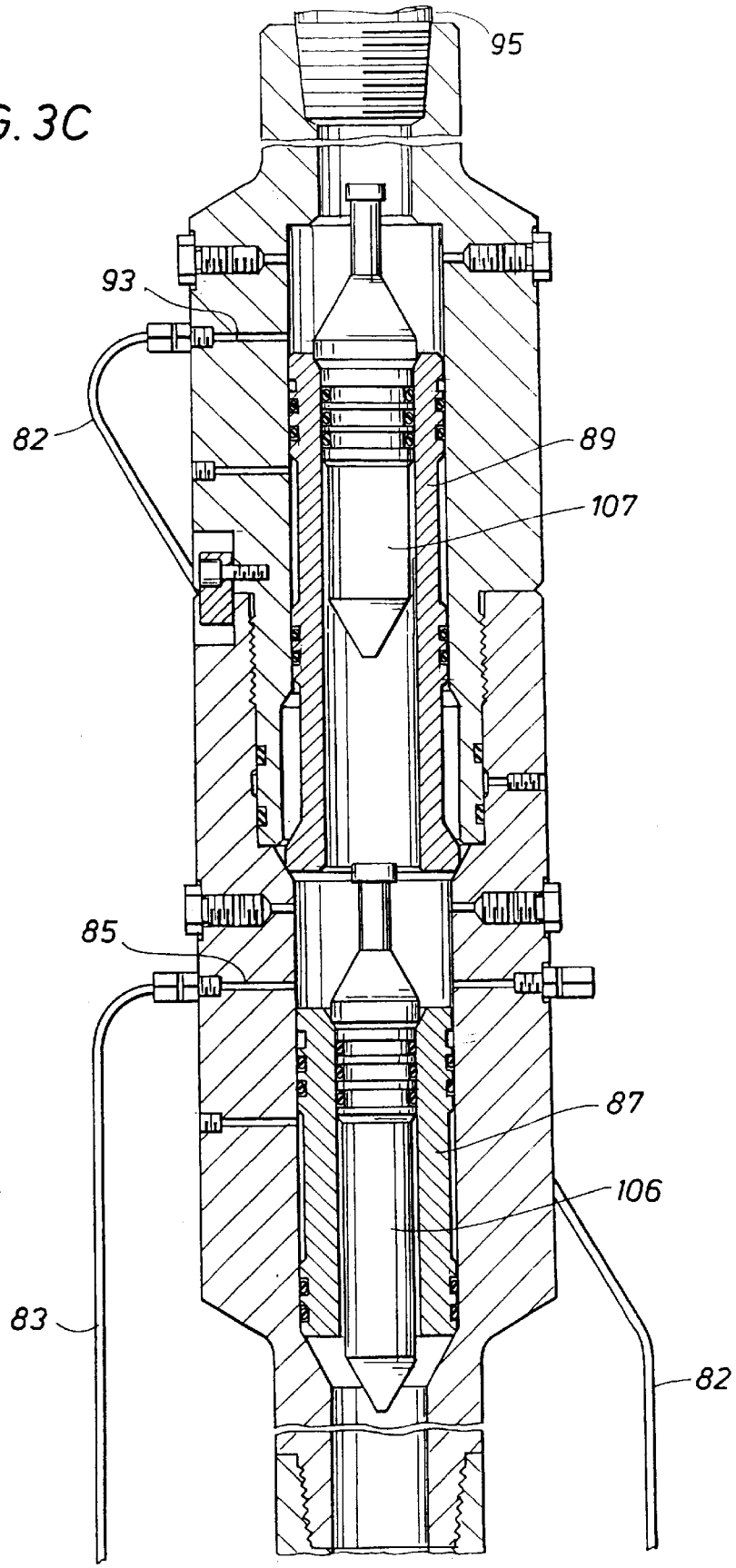
FIG. 3C shows the condition of the hydraulic sub of FIG. 3B after a second dart has been installed for enabling pressure to test the seal assembly of FIG. 3A.

As illustrated in FIG. 3C a second or "upper" dart 107 is launched via the interior of drill sting 95. After the upper dart 107 is landed in upper sealing sleeve 89, the pressure in the hydraulic path is increased to move the upper sealing sleeve 89 downward as illustrated in FIG. 3C thereby opening port 93 and applying pressure to line 82. The hydraulic pressure is increased up to 1000 psi which is applied between O-ring seals 21. (See FIG. 3A). If the pressure does not bleed off, as observable at the surface vessel by reference to gage 104, the O ring seals 21 are properly engaged.

Figure 6A:
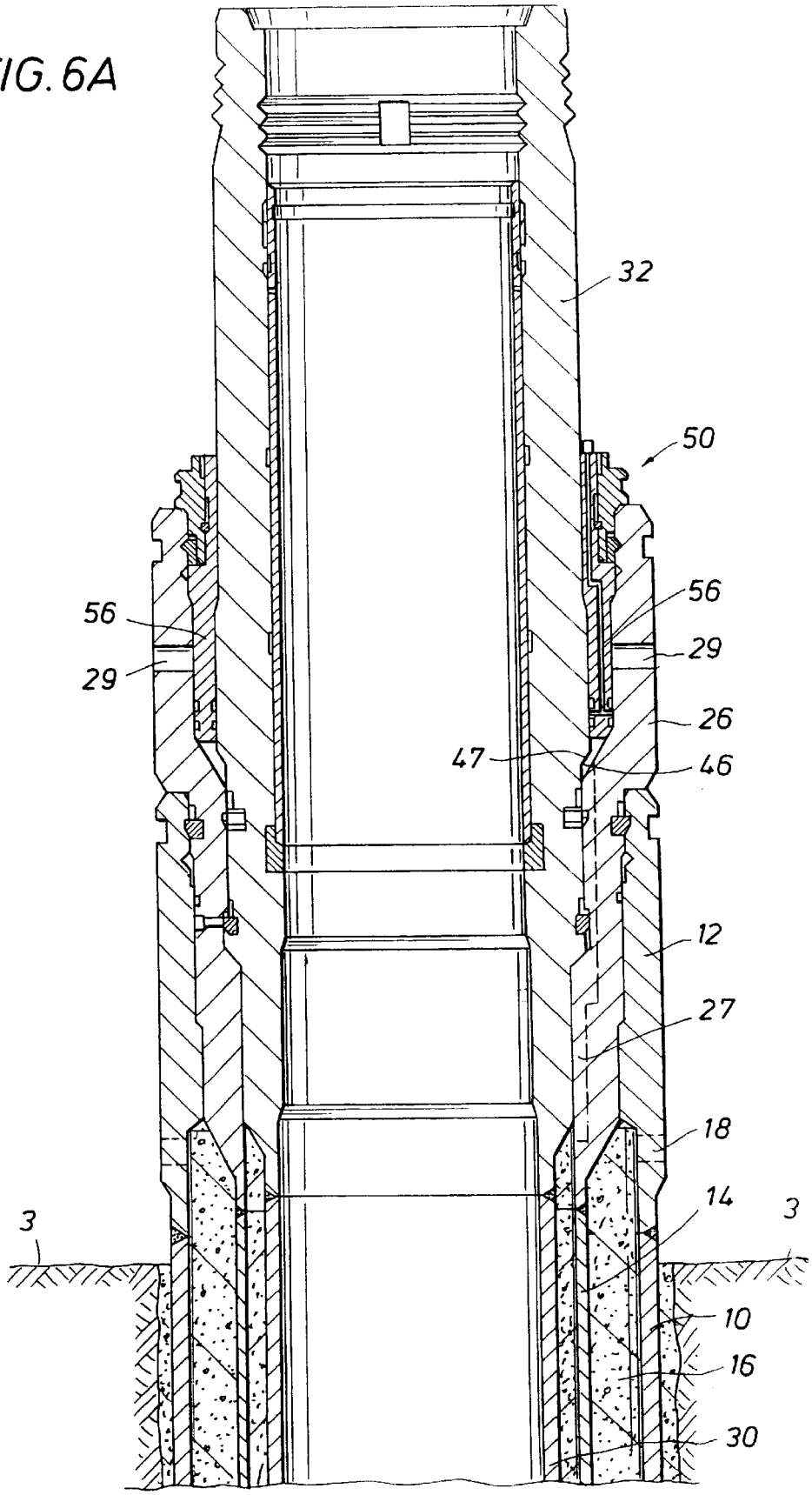
FIG. 6A illustrates the pack-off assembly with its seal below the flow-by holes of the 26" wellhead housing and after the running tool has been removed from the wellhead assembly.

FIG. 6A illustrates the upward locking 18¾" housing with pack-off assembly 80 installed after the running tool 111 has been returned to the surface.

Description of Retrieving Pack-Off Assembly 80

Figures 1, 6B:
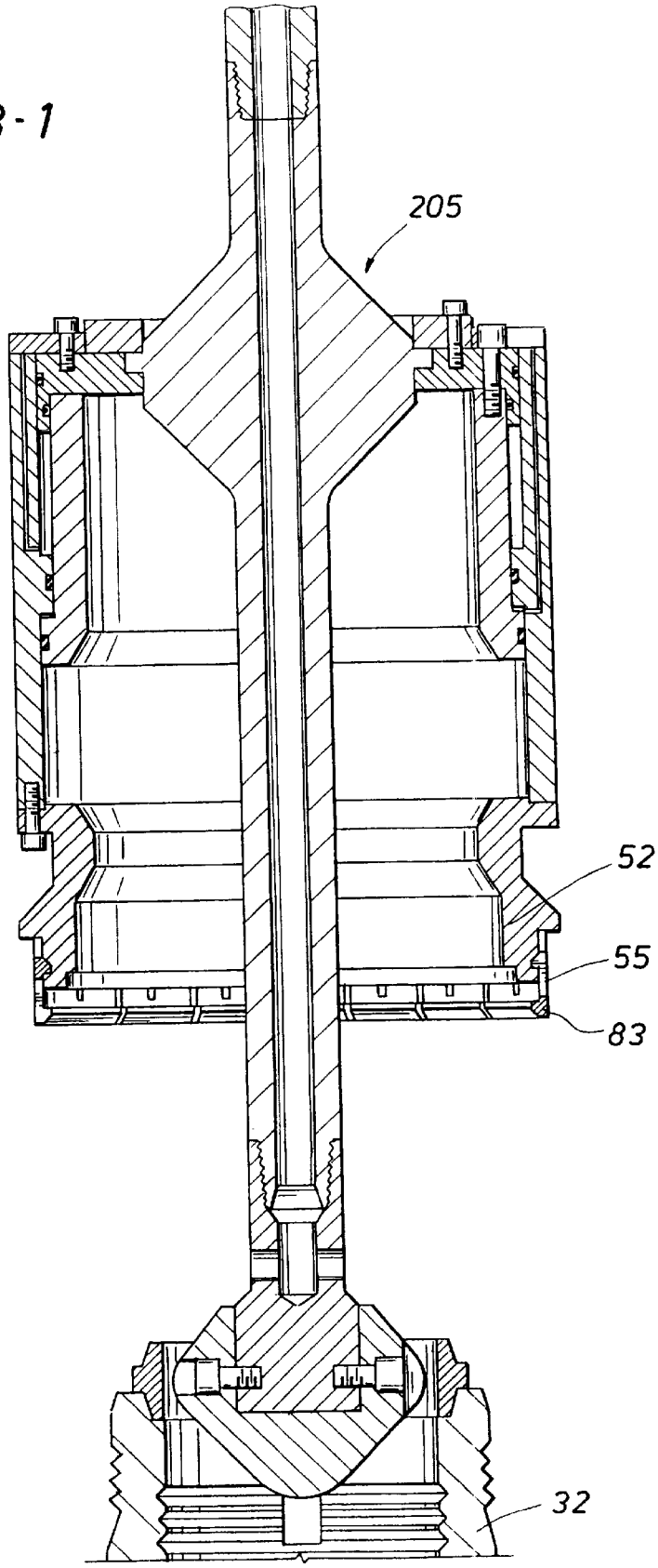
Figures 2, 6B:
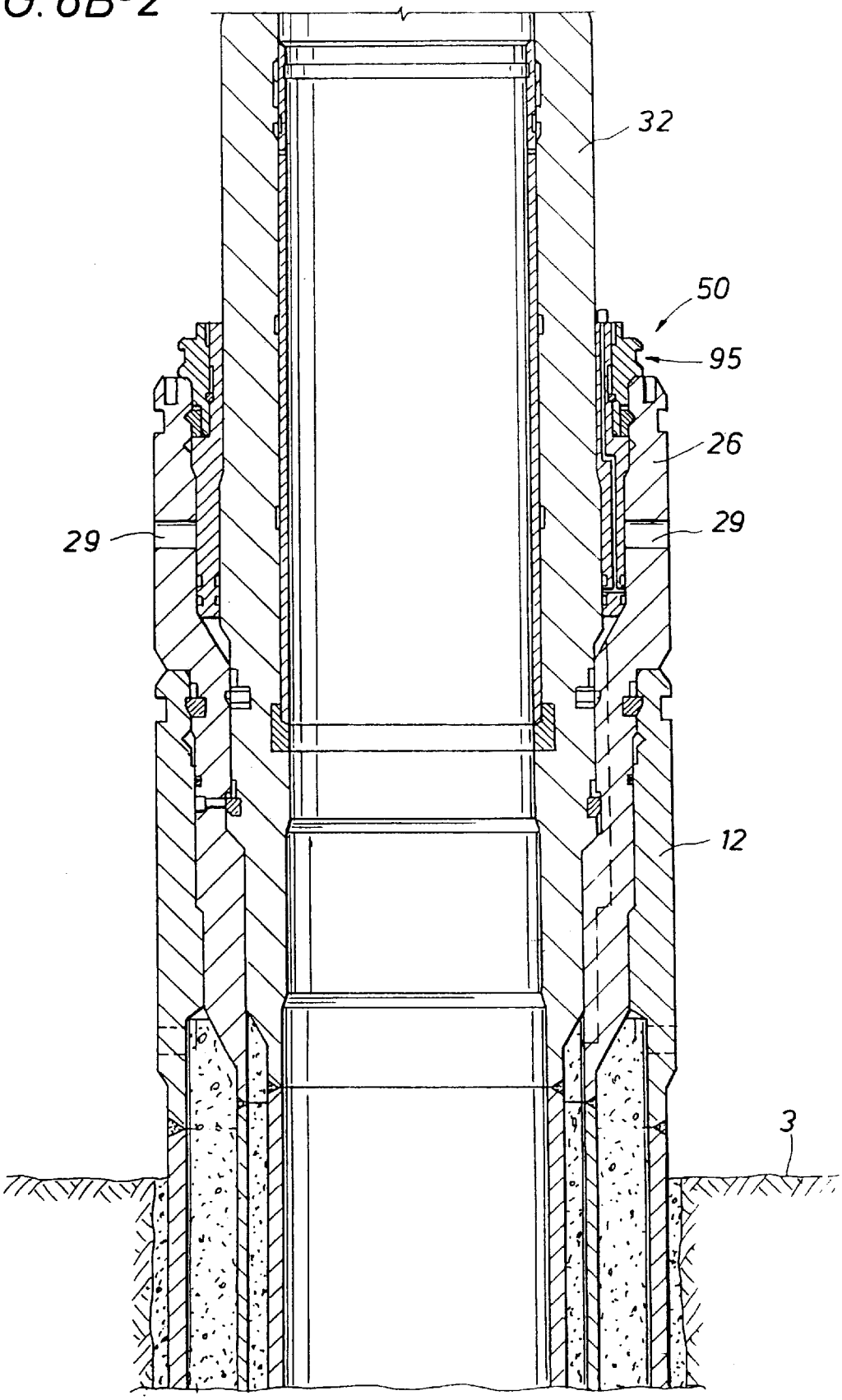
Figure 6C:
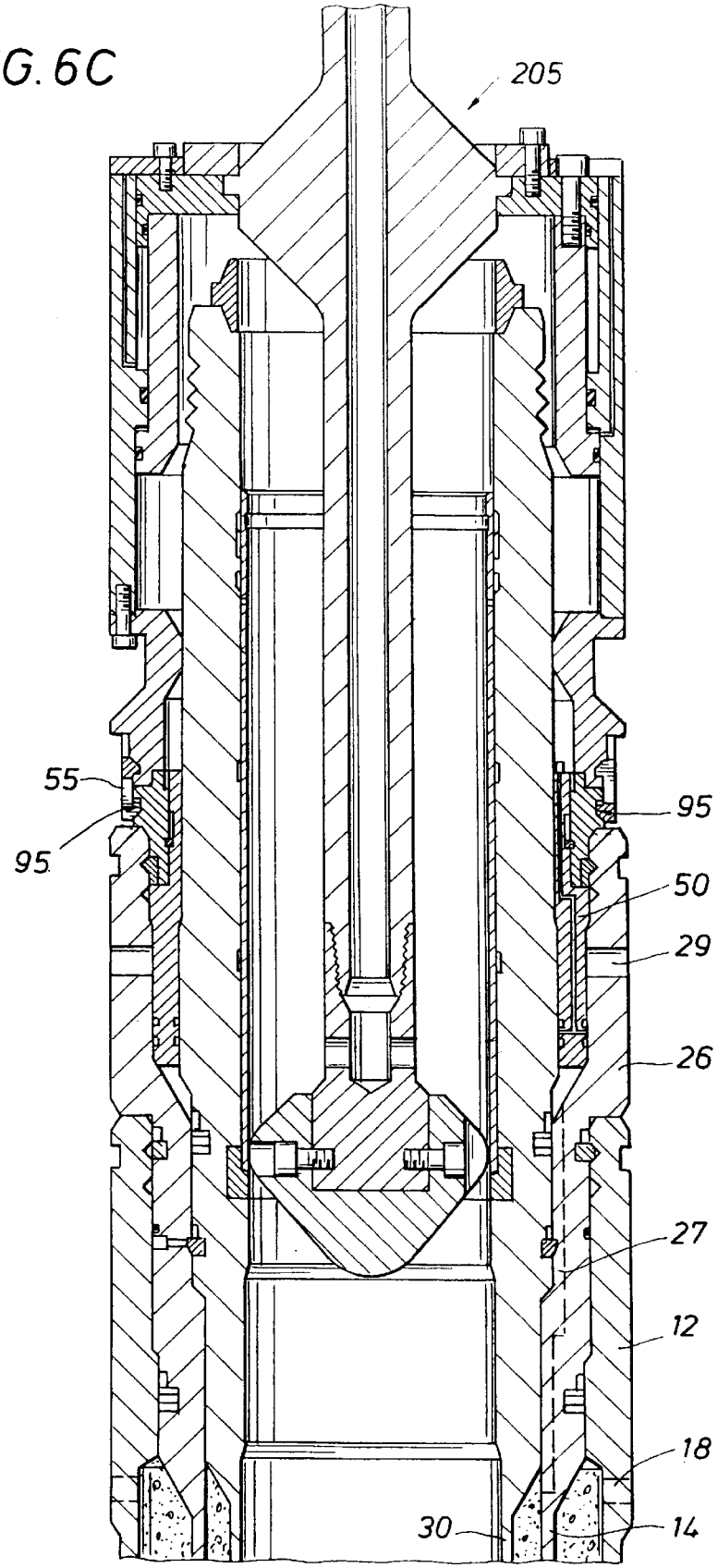
FIG. 6C illustrates the retrieving running tool of FIG. 6B-1 after it has been lowered into the 18¾" wellhead housing and the latching mechanism secured to the pack-off assembly.
Figures 1, 6D:
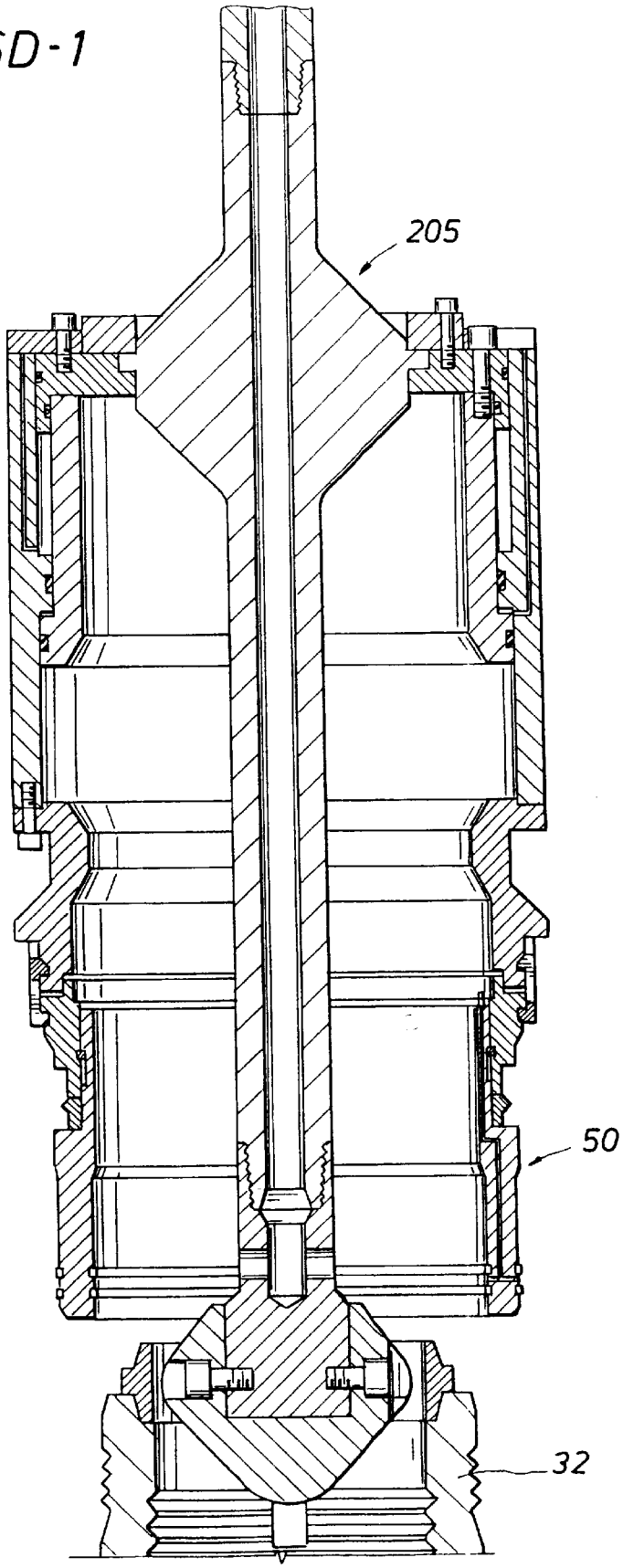
Figures 2, 6D:
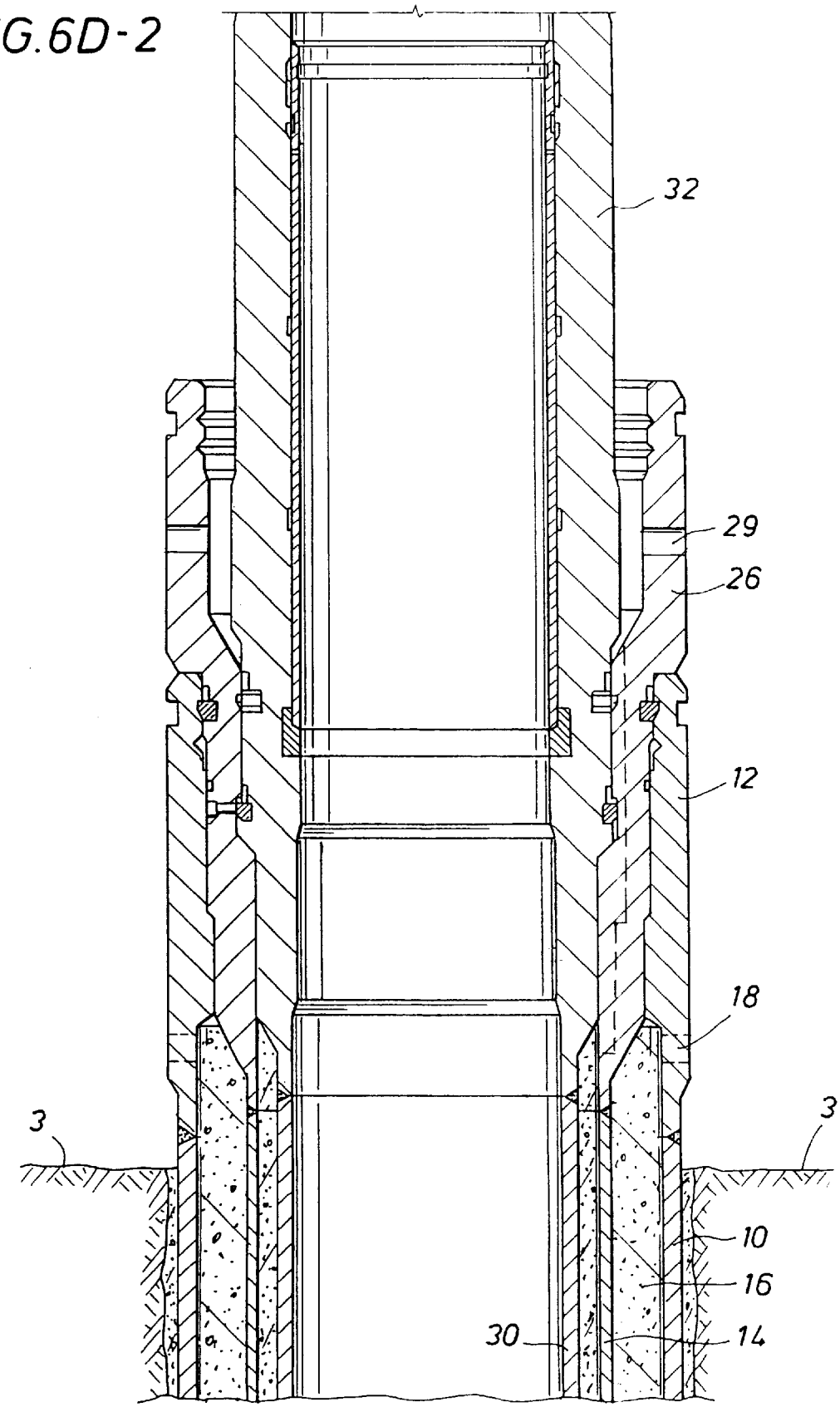

FIG. 2A-1 illustrates the orientation of the latch or (running and retrieval ring) member 55 for running the pack-off assembly 50 into the annulus 33 between the 26" housing 26 and the 18¾" housing 32. FIG. 6B-1 shows that when the pack-off assembly 50 is to be retrieved, (as from the orientation of FIG. 6A), the running and retrieval ring 55 is turned upside down and secured to connection member 52. The end 83 of running and retrieval ring 55 now extends downwardly. FIG. 6C illustrates the latch ring 55 after it has landed at the top end of the pack-off assembly 50. The latch ring 55 cams radially outwardly so as to snap into groove 95 (FIG. 6B-2, 6C) and then the running tool is pulled up from the hole while pulling pack-off assembly 50 out of the annulus 33. FIGS. 6D-1, 6D-2 show the pack-off assembly 50 separated from the 18¾" housing 32 during retrieval.

Various modifications and alterations which are equivalent to the described structures and methods will be apparent to those skilled in the art of the foregoing description which do not depart from the spirit of the invention. For this reason, such equivalent structures are desired to be included in the scope of appended claims. The claims which follow recite the only limitation to the present invention and the descriptive manner which is employed for setting forth the embodiments of the invention are to be interpreted as illustrative and not limitative.

What is claimed is:

1. A subsea well assembly comprising:

a first wellhead housing (26) secured to a first string of pipe (14) which is cemented into earth formations, said wellhead housing (26) having a sidewall with a plurality of flow ports (29), said housing having an internal landing profile (46);

a second wellhead housing (32) secured to a second string of pipe (30) which extends through said first string of pipe (14), said second wellhead housing (32) having an external profile (47) which is landed on said internal landing profile (46) and is supported within said first wellhead housing (26), said first and second wellhead housings defining an annular space (33) which communicates with said flow ports (29) of said first wellhead housing (26), and with a return path between said first and second strings (14, 30) of pipe;

a retrievable seal assembly (50), including a seal (51) disposed at least partially in said annular space (33), said seal assembly (50) characterized by being selectively capable of being placed in said annular space (33) such that said seal (51) is above said flow ports (29) for allowing cement returns from said return path between said first and second strings of pipe (14, 30) to exit said first wellhead housing (26), and of being placed such that said seal (51) is below said flow ports (29) for sealing said annular space (33) from formation water flow between said first and second strings of pipe (14, 30);

means controllable from a vessel (200) location for forcing said seal assembly (50) downward in said annular space (33) until said seal (51) is below said flow ports (29); and means controllable from a vessel (200) location for retrieving said seal assembly (50) from said annular space (33).

2. A subsea well assembly comprising:

a first wellhead housing (26) secured to a first string of pipe (14) which is cemented into earth formations, said wellhead housing (26) having a sidewall with a plurality of flow ports (29), said first wellhead housing (26) having an internal landing profile (46);

a second wellhead housing (32) secured to a second string of pipe (30) which extends through said first string of pipe (14), said second wellhead housing (32) having an external landing profile (46) by which said second wellhead housing (32) is supported on said internal landing profile (46) within said first wellhead housing (26), said first and second wellhead housings defining an annular space (33) which communicates with said flow ports (29) of said first wellhead housing (26) and with a return path between said first and second stings (14, 30) of pipe;

a seal assembly (50), including a seal (51), disposed at least partially in said annular space (33), said seal assembly (50) characterized by being selectively capable of being placed in said annular space (33) such that said seal (51) is above said flow ports (29) for allowing cement returns from between said first and second strings of pipe (14, 30) to exit said first wellhead housing (26), and of being placed such that said seal (51) is below said flow ports (29) for sealing said annular space (33) from formation water flow from said return path between said first and second strings of pipe (14, 30);

a running tool assembly (111) selectively capable of being controlled via a hydraulic path from a surface vessel (200) supply (102) of hydraulic pressure for forcing said seal assembly (50) downward in said annular space (33) until said seal (51) is below said flow ports (29); and a feedback mechanism coupled to said running tool assembly (111) and to said seal assembly (50) for generating a pressure signal at said surface vessel (200) in said hydraulic path, said pressure signal being representative of the position of said seal (51) in said annular space (33).

3. The assembly of claim 2 wherein, said running tool assembly (111) includes an actuator (60) which is coupled to said seal assembly (50) and includes a mechanism (80) which selectively connects said running tool assembly (111) in said hydraulic path to said sea surface supply of hydraulic pressure (102) on said surface vessel (200) and;

said feedback mechanism (65) is coupled with said actuator (60) and to a vessel signaling device (104) via said hydraulic path to produce an indication at the vessel as to the position of said seal (51) in said annular space (33).

4. In combination with well head apparatus including a first wellhead housing (26) secured to a first casing string (14) which is cemented into earth formations, said first wellhead housing (26) having a sidewall with a flow port (29), said first wellhead housing (26) having an internal landing profile (46), apparatus which simultaneously, runs a second wellhead housing (32) which is secured to a second casing string (30) through said first wellhead housing (26) and said first casing string (14) and into a borehole drilled through said first casing string and until an external profile (47) of said second wellhead housing (32) lands on said internal landing profile (46) of said first wellhead housing (26) with said second casing string running downward into said borehole, for defining an annular space (33) between said first and second wellhead housings (26, 32) which is in communication with said flow ports (29) of said first wellhead housing (26); and runs a seal assembly (50) into said annular space (33).

5. The combination of claim 4 wherein said apparatus is further simultaneously runs a cementing tool into said borehole.

6. A running tool (111) for lowering subsea well apparatus with a single trip from a surface vessel (200) to a first wellhead housing (26) secured to a first casing string (14) which is cemented into subsea earth formations, said first wellhead housing (26) having a sidewall with a flow port (29), said first wellhead housing (26) having an internal landing profile (46), said running tool being releasably secured to:

a second wellhead housing (32) which is secured to a second casing string (30), said second wellhead housing (32) and said second casing string (30) arranged and designed to be lowered into a borehole drilled through said first casing string (14) until an external profile (47) of said second wellhead housing (32) lands on said internal landing profile (46) of said first wellhead housing (26) thereby defining an annular space (33) which is in communication with said flow port (29) of said first wellhead housing (26), and a seal assembly (50) which is arranged and designed to be placed within said annular space (33) when said second wellhead housing lands within said first wellhead housing.

7. The running tool (111) of claim 6 wherein said running tool is further coupled to a cementing tool (21) which is lowered simultaneously into said borehole with said second wellhead housing (32) and said seal assembly (50) when lowered into said first wellhead housing (26) and through said first casing string (14).

8. A method of casing a subsea well comprising the steps of:

installing a first wellhead housing (26) secured to a first casing string (14) into earth formations of a first borehole drilled to a depth above a shallow water flow zone (9), where said first casing string (14) is cemented into said borehole and said first wellhead housing (26) has a side wall with a flow port (29), drilling a second borehole through said first casing sting (14) through lower earth formations to a depth below said shallow water flow zone (9), with a running tool (111) lowered by means of drill pipe (95) from a surface vessel (200), where said running tool (111) carries a second wellhead housing (32) having a second casing string (30) secured thereto and carrying a seal assembly (50), installing, with a single lowering of said running tool with said drill pipe, said second wellhead housing (32) with said second casing string (30) attached thereto such that said second casing string (30) is placed in said second borehole and said second wellhead housing (32) is landed in said first wellhead housing (26), said first and second wellhead housings being arranged and designed such that when said second wellhead housing (32) is landed within said first wellhead housing (26), an annular space (33) is defined which communicates with said flow ports (29) of said first wellhead housing (26), and a seal assembly (50) including a seal (51) in said annular space (33) at a position such that said seal is above said flow ports (29).

9. The method of claim 8 where said running tool (111) further includes, a cementing tubular string (40) attached to the bottom of said running tool (111) and a cementing shoe (21) attached to the bottom of said tubular string, the method further comprising the steps of pumping cement through said running tool and said cementing tubular string (40) and said cementing shoe with return cement between said second casing string (30) and said second borehole flowing via said flow port (29), and forcing said seal assembly into said annular space (33) to a position such that said seal (51) is below said flow ports (29), thereby preventing shallow water flow from said shallow water flow zone (9) through said first and second wellhead housings into the sea.

* * * * *